US007410008B2

(12) United States Patent
Jahnigen

(10) Patent No.: US 7,410,008 B2
(45) Date of Patent: Aug. 12, 2008

(54) GROUND ROD DRIVER

(76) Inventor: Timothy J. Jahnigen, 757 N. Mesa Rd., Millersville, MD (US) 21108

( * ) Notice: Subject to any disclaimer, the term of this patent is extended or adjusted under 35 U.S.C. 154(b) by 68 days.

(21) Appl. No.: 11/142,966

(22) Filed: Jun. 2, 2005

(65) Prior Publication Data

US 2006/0272835 A1 Dec. 7, 2006

(51) Int. Cl.
*F21C 5/12* (2006.01)

(52) U.S. Cl. ..... 173/184; 173/30; 173/141; 173/147; 173/211

(58) Field of Classification Search ..... 173/147, 173/152, 109, 184, 28, 141, 211, 30, 210
See application file for complete search history.

(56) References Cited

U.S. PATENT DOCUMENTS 2,990,022 A * 6/1961 Muller et al. ..... 173/49
3,681,035 A * 8/1972 Selman et al. ..... 423/15
3,854,537 A * 12/1974 Nelmark et al. ..... 173/140
3,960,360 A * 6/1976 Elliston ..... 166/77.4
4,124,081 A * 11/1978 Deike ..... 173/28
4,137,974 A * 2/1979 Decker ..... 173/147
4,336,840 A * 6/1982 Bailey ..... 166/77.4
4,478,291 A * 10/1984 Futros ..... 173/147
5,226,488 A * 7/1993 Lessard et al. ..... 175/61
5,294,318 A * 3/1994 Grant et al. ..... 204/245
5,375,664 A * 12/1994 McDowell et al. ..... 173/1
5,584,603 A * 12/1996 Cortlever ..... 405/50
5,746,277 A * 5/1998 Howell, Jr. ..... 173/184
6,293,359 B1 * 9/2001 Dobran et al. ..... 175/195
6,305,480 B1 * 10/2001 Franklin ..... 173/27
6,705,407 B2 * 3/2004 Heinonen et al. ..... 173/105
6,725,946 B2 * 4/2004 Howell, Jr. ..... 173/184

* cited by examiner

*Primary Examiner*—Scott A. Smith
(74) *Attorney, Agent, or Firm*—Jeffrey C. Maynard

(57) ABSTRACT

A ground rod driver that uses an industry standard connecting plate to physically attach the driver to Skid Steer type equipment. The driver has a hydraulic, impact driving hammer connected to an alignment beam that enables vertical movement of the hammer. Operation of the driving hammer, as well as up and down motion of the driving hammer is derived from the accessory hydraulic system and connections of the Skid Steer. Simple operating control valves, flow control valve and hydraulic hoses, and an operating station are mounted directly to the driver.

17 Claims, 5 Drawing Sheets

GROUND ROD DRIVER

BACKGROUND OF THE INVENTION

1. Field of the Invention

This invention relates to a hammer device for driving ground rods into the earth, and more specifically to a hammer device that can be attached to standard construction machinery.

2. Background of the Prior Art

When erecting high voltage, electric transmission poles, all pole installations require ground rods to be driven at each location where a pole is installed. This part of the construction requires driving as many as ten or more ground rods in succession at each pole location. Such ground rods are typically ⅝" to ¾" in diameter and 8' to 10' in length. The normal installation method is to drive one rod into the earth adjacent to the new pole location, couple successive rods on top of any previous rod, and continue driving until the total length driven into the ground is 70' or more. The purpose of driving such ground rods in this manner is to achieve an electrical resistance level as required by design. These ground rods are connected to the new steel poles using copper wire to create a path for any electrical over current condition.

The type of equipment that the present invention is designed to be used with is known as a Skid Steer. Many companies manufacture this type of machine and each company has different variations for what equipment can be attached and how the machine is propelled. Some machines have rubber tires, some have tracks, and some have a combination of both. All Skid Steer type equipment has an industry standard attachment plate on the front of the machine to connect various types of apparatuses or attachments to the actual equipment. Such attachments are many and perform all types of functions. There are buckets for digging earth, chain devices for trenching, backhoe attachments for earth excavating, augers for drilling holes, hammers for breaking concrete or rock, etc. Nevertheless, none of these attachments can be used to drive ground rods.

SUMMARY OF THE INVENTION

There are many types of standard ground rod drivers available. None of the available drivers combines standard equipment available on a job site, such as Skid Steer machinery, with a ground rod-driving hammer. The new tool of the present invention is designed to attach onto existing equipment to make driving ground rods safer and faster.

A principal concept of the present invention is to build an attachment that is used in the vertical position and stored in the horizontal position. The attachment will make use of the industry standard connecting plate to physically attach the apparatus to the Skid Steer type equipment. The attachment will have a hydraulic, impact driving hammer connected to an alignment beam that enables vertical movement of the hammer. Operation of the driving hammer, as well as up and down motion of the driving hammer will be derived from the available accessory hydraulic system and connections of the Skid Steer. With some simple operating control valves, flow control valve and necessary hydraulic hoses, an operating station can be mounted directly to the attachment.

The basic operation of the present invention is that the device is connected to the Skid Steer both mechanically and hydraulically. One person operating the Skid Steer raises the alignment beam, positions it vertically to the desired location for ground rod installation, and applies down pressure to stabilize the attachment. A second person operates the actual ground rod driver from an operating station by first raising the driving hammer, and inserting one end of a ground rod into the hammer. Then lowering the hammer (with the upper end of the ground rod inserted in the hammer) and positioning the bottom end of the ground rod at the proper position near the bottom plate until the ground rod begins to penetrate the earth. At this point, the ground rod driver operator turns on the hammer and begins to lower the hammer while the hammer is turned on. These operations work simultaneously until the ground rod is driven completely into the earth. Then the hammer is turned off, and raised to allow another ground rod to be connected. The process is repeated, as necessary, until a sufficient number of ground rods have been driven into the ground.

It is, therefore, an object of the present invention to provide a ground rod driver that avoids the disadvantages of the prior art.

Another object of the present invention is to provide a ground rod driver that can be attached to an industry standard Skid Steer attachment plate.

This invention enables a ground rod driver that is portable by being mounted on a moveable platform, such as a Skid Steer. The ground rod driver is constructed in a way such that operation of the hammer is independent of up and down movement of the hammer.

According to the present invention, the ground rod driver is an attachment to Skid Steer type equipment. Skid Steer type equipment can access site conditions not favorable by other types of equipment. This will allow installation of ground rods in locations that typically would have to be done manually. Skid Steer equipment is used on most job sites that would require ground rod installations. The attachment utilizes the already available accessory hydraulic system and physically connects to the machine by a standard attachment plate used for all skid steers.

The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following description, which should be read in conjunction with the accompanying drawings in which like reference symbols are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
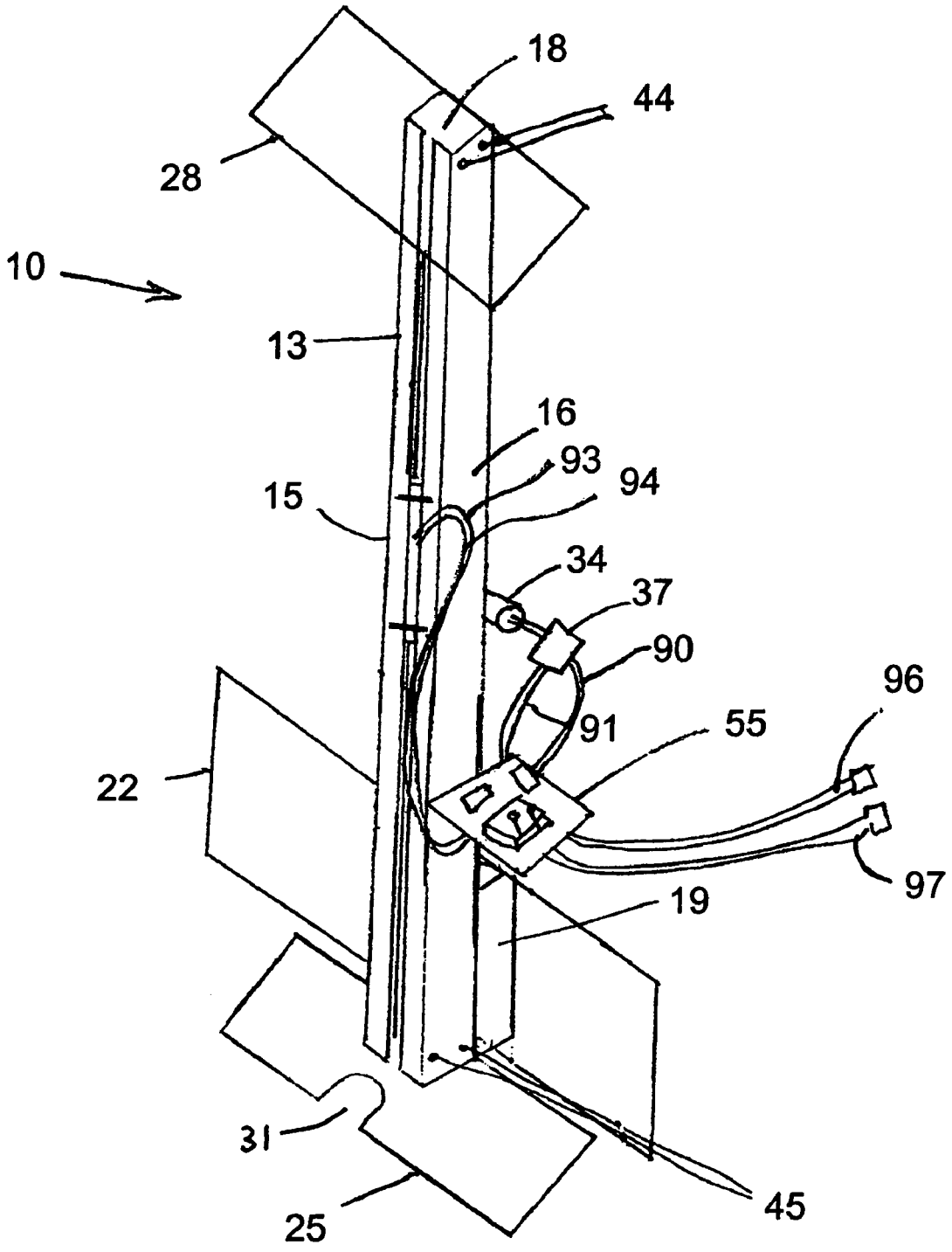
FIG. 1 is a perspective view of a ground rod driver according to the present invention.

Referring to the figures, FIG. 1 shows a ground rod driver, indicated generally as 10, according to the present invention. The driver 10 comprises a main beam 13 of suitable length and strength having a left portion 15 and a right portion 16, forming a hollow channel 18 therein. A second, shorter box beam 19 is attached to a bottom portion of the backside of beam 13 to enable an attachment plate 22 to be attached thereto. The attachment plate 22 is sized and configured to enable the ground rod driver 10 to be connected to an industry standard skid steer The second shorter box beam 19 provides additional strength to the main beam 13 and attachment plate 22, while providing clearance to allows cables to be routed through the hollow channel 18. The main beam 13 of driver 10 has a footplate 25 attached to the bottom of main beam 13 perpendicular to the length of beam 13, and a top plate 28 attached perpendicularly to the top of main beam 13.

Footplate 25 serves three functions: it stabilizes the driver 10 when being used in the vertical position during driving operations; it serves as a resting point to support the driver 10 when such driver 10 is stored or transported in the horizontal position in a manner in which the components of the driver 10 is secure and not damaged; it enables positioning of a ground rod in. the proper location for driving operation. A notch 31 cut in footplate 25 assists in aligning the ground rod.

Top plate 28 is attached to the top of main bean 13 to serve as a second resting point for storing or transporting the driver 10. Top plate 28 may be removable for maintenance of the working parts of the driver 10.

Figure 2:
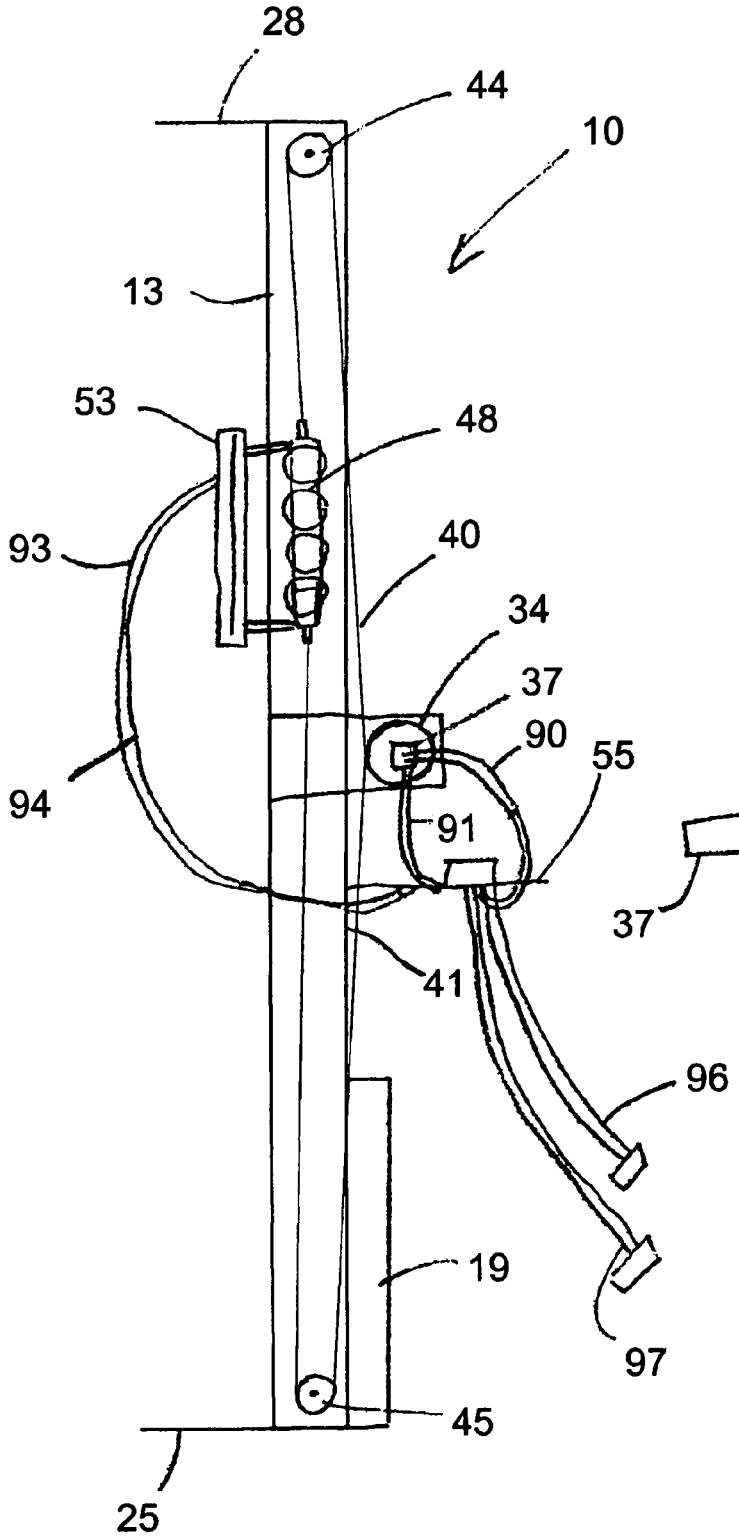
FIG. 2 is a side elevational view of a ground rod driver according to the present invention.
Figure 2A:
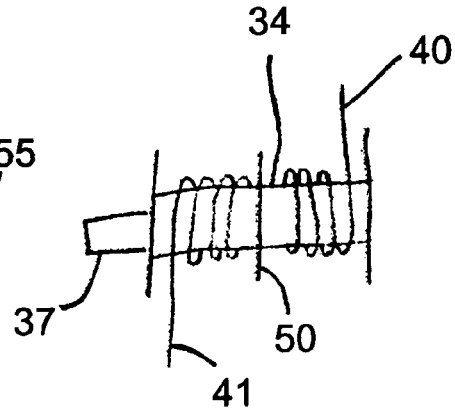
FIG. 2*a* is an elevational view of a hydraulic motor and drum according to the present invention.

Referring to FIG. 2, a drum 34 is mounted to the backside of the main beam 13 by means of bearings to allow rotation of the drum 34 while holding the position of the drum constant. The drum 34 is rotated by a hydraulic motor 37 that is also attached to the main beam 13. Two cables 40, 41 are attached to the drum 34 and guided to the top and bottom ends of the main beam 13 through sheaves 44, 45. Cable 40 is attached to the top of sled 48 and cable 41 is attached to the bottom of sled 48. The drum 34 has a center separator 50 to keep the two cables from interfering with each other, as shown in FIG. 2*a*. A hydraulic hammer 53 is attached to the sled 48 by a mounting system that allows the hammer 53 to vibrate independently from the sled 48. The hydraulic motor 37 that propels the sled 48 and attached hammer 53 is controlled from the operating station 55 (FIGS. 1 and 2). When the hydraulic motor 37 rotates in one direction, the sled 48 is propelled upwards within the main beam 13. When the hydraulic motor 37 rotates in the other direction, the sled 48 is propelled downwards within the main beam 13.

Figure 3:
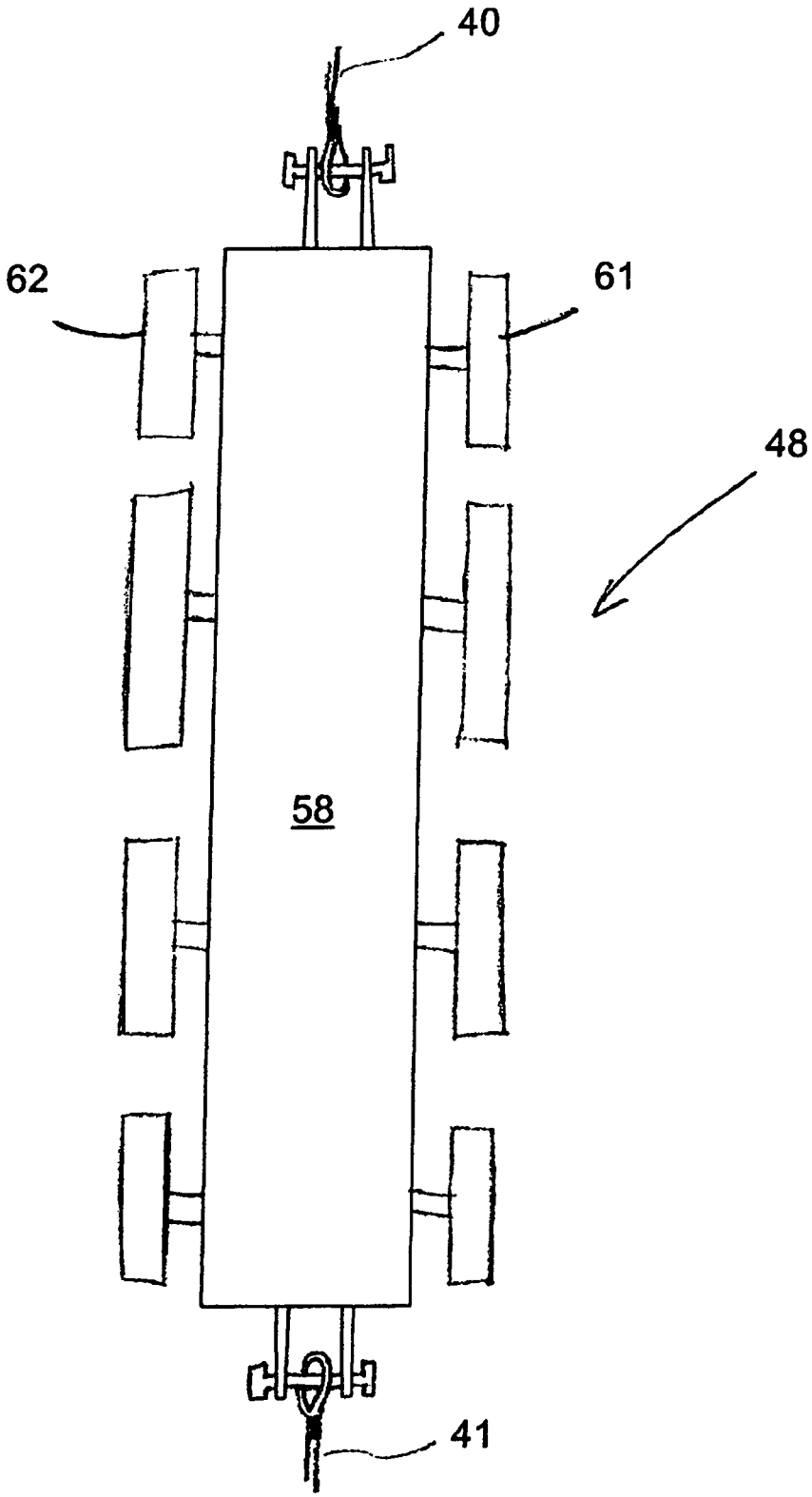
FIG. 3 is an elevational view of a sled portion of a ground rod driver according to the present invention.

As shown in FIG. 3, the sled 48 comprises a body 58 having a plurality of rollers, such as 61, 62 on two sides that allow the sled 48 to travel up and down inside the channel 18 for the entire length of the main beam 13. The sled 48 is propelled inside the main beam 13 by means of hydraulic motor 37 moving cables 40, 51 through sheaves 44, 45.

Figure 4:
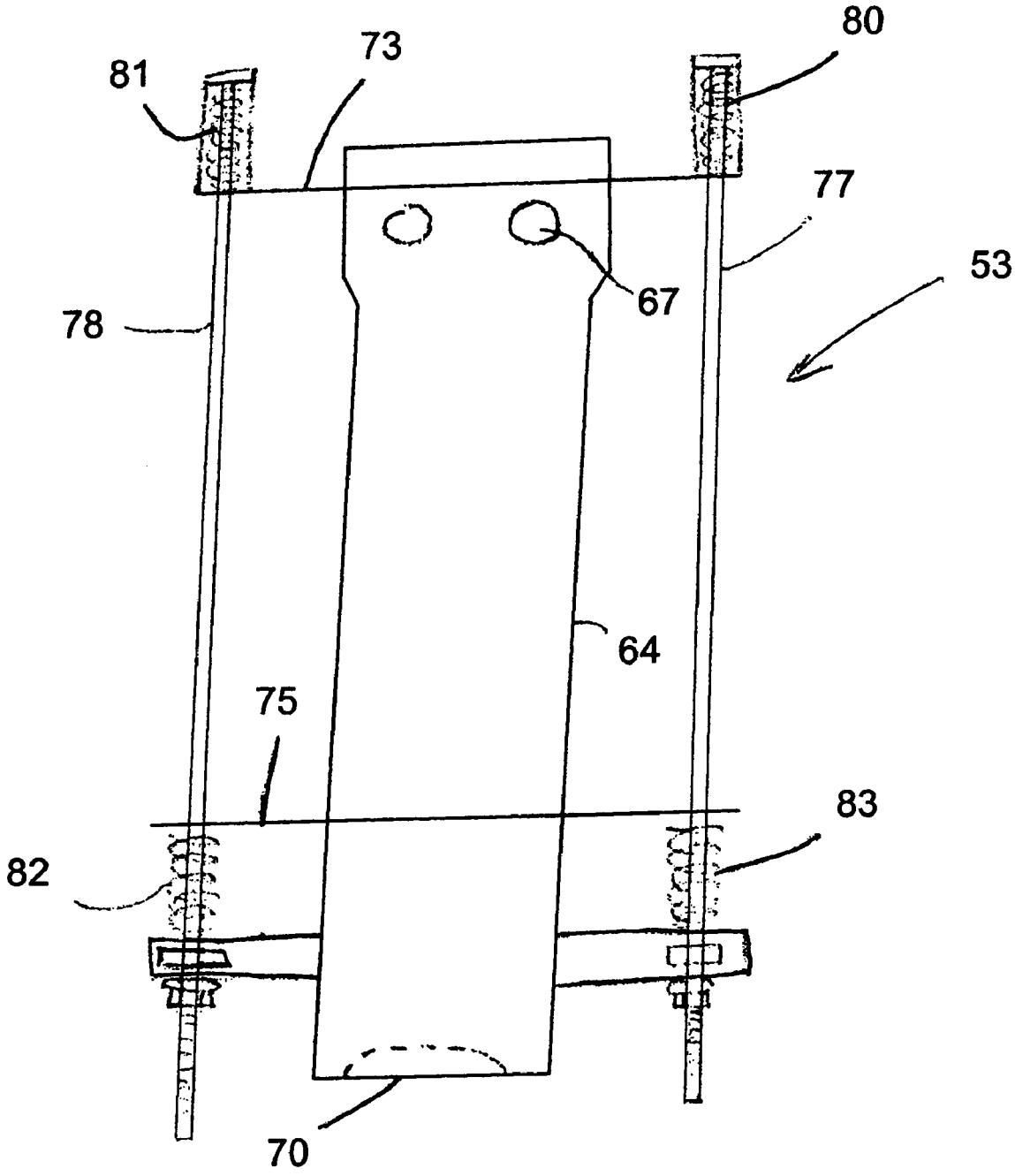
FIG. 4 is an elevational view of a hammer portion of a ground rod driver according to the present invention.
Figure 5:
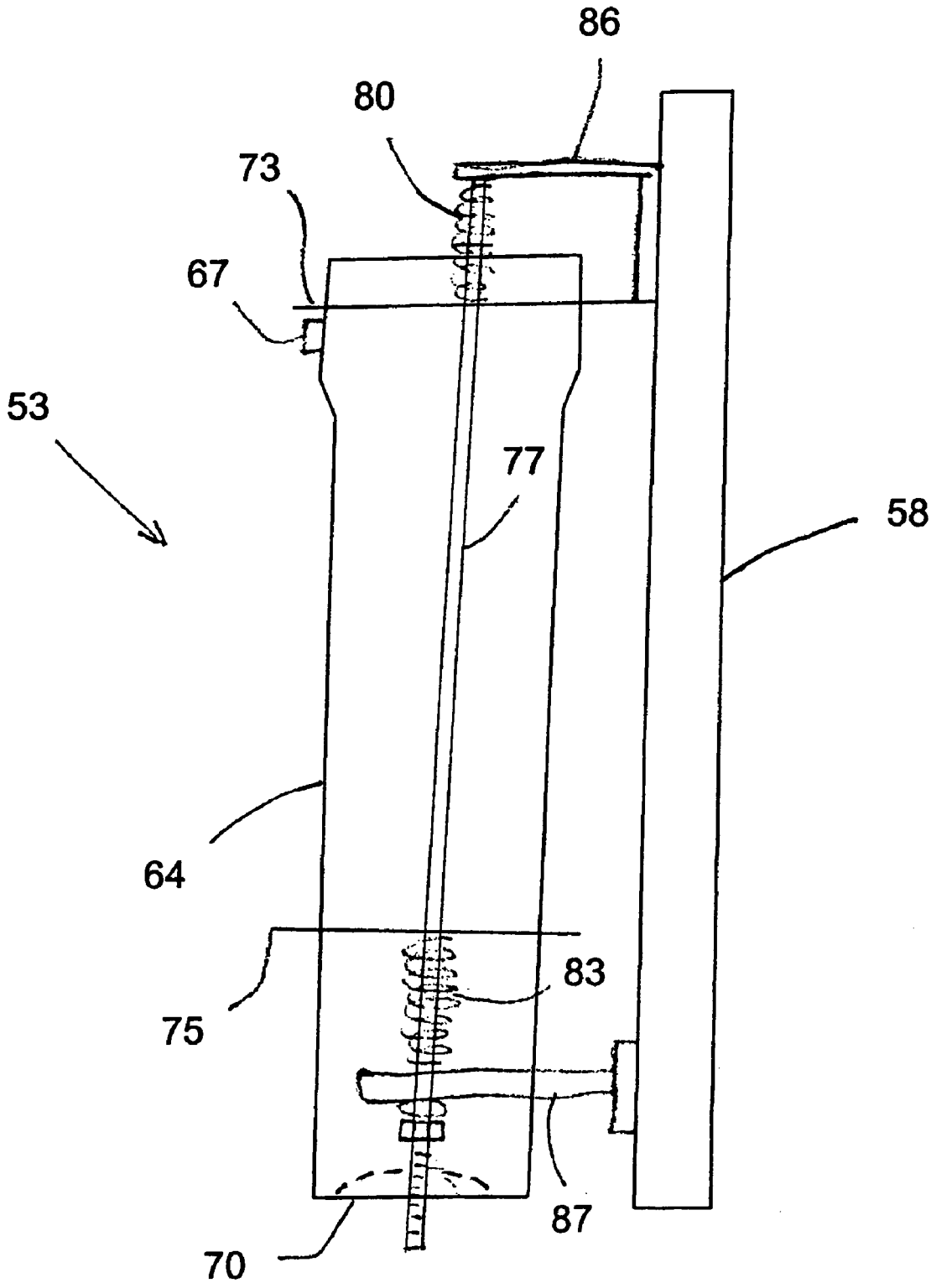
FIG. 5 is a right-side view of the hammer of FIG. 4.

FIGS. 4 and 5 show a hydraulic impact hammer 53 according to the present invention. The hammer 53 comprises a cylinder 64 having at least one hydraulic hose connections, such as 67. In a typical configuration, cylinder 64 has a concave detent 70 on a bottom portion to engage a ground rod when driving such ground rod into the earth. An upper alignment plate 73 and lower alignment plate 75 are attached to cylinder 64. Vibration rods 77, 78 are slidably engaged with upper alignment plate 73 and lower alignment plate 75, through apertures in the outer portion of such alignment plates. Springs 80, 81, 82, and 83 are positioned on vibration rods 77, 78 between the alignment plates 73, 75 and mounting brackets 86, 87. The mounting brackets 86, 87 are attached to the body 58 of sled 48. The springs 80, 81, 82, and 83 decouple the vibration of hammer 53 from the sled 48 so that the vibration is not transferred to the rest of the driver 10.

The hydraulic motor is connected to the operating station 55 by hoses 90, 91, and the hydraulic hammer 53 is connected to the operating station 55 by hoses 93, 94. The operating station 55 is connected to the hydraulic power supply by two main hoses 96, 97. In a preferred embodiment, all such hoses are made to have quick attachment type couplers that are an industry standard for accessory connections.

The operating station 55 comprises two control valves: one that operates the hammer 53 vibrating on and off, and one that controls up and down motion of the sled 48 and subsequently hammer 53.

The disclosed embodiment uses an industry standard attachment plate 22 with available accessory hydraulic connections and system of a skid steer machine to operate the driver 10. The manner in which the attachment plate 22 is affixed to the skid steer already allows for two operations controlled by the operator of the skid steer. In the present invention, the operations include raising and lowering the actual driver device 10 as well as tilting the driver 10 forward and aft to maintain a plumb condition. There is no side-to-side leveling device on most skid steers but one could be added between the industry standard attachment plate and the beam if the attachment would require this function.

The hammer 53 is attached to the sled 48, operates off the hydraulic system of the skid steer, and is controlled from the operating station 55. When the control valve is turned on the hammer 53 begins to impact the ground rod. When the control valve is turned off, the hammer 53 stops.

Because the hydraulic hammer 53 is attached to the sled 48 mounted inside the main beam 13 and travels by means of hydraulically operated up and down force, there is no possibility of the hammer 53 falling or slipping onto a man below holding the ground rod. This type of hazard does exist when prior art hammers are hand held and positioned on top of the ground rods being installed. The prior art procedure of using hand held hammers has potential accident/injury possibilities because the hammer may slip from the grip of the operator, or the operator can possibly injure himself by allowing a part of his body to be in a position between the hammer and whatever means they use to attain the elevation to drive the ground rod.

The ground rod driver of the present invention can be attached or detached to Skid Steer type equipment in less than 5 minutes and does not require any other equipment to perform this task. Once attached the installation process is of the most efficient methods available. The ground rod driver uses two principles, vibration from the hammer as well as downward pressure from the sled, to install each ground rod as quickly and safely as possible.

While a preferred embodiment has been described, it is envisioned that several variations and potential improvements can be included, such as:

1. The hydraulic system can be computerized to monitor down pressure and vibration force to obtain maximum productivity.

2. The arrangement between the sled inside a box beam can be modified to an H-beam or other type steel with outside guides for the sled to travel.

3. The same design for the hammer, sled, and track can be used to drive other types of required installations, while utilizing the industry standard "skid steer" plate and tapping the hydraulic system of skid steers. This could include fence post, pile driving, sheet pile installations and other types of installation of materials that could benefit from this design utilizing "skid steer" type equipment.

4. The operating station can be modified such that a platform or operator's stand is part of the attachment to isolate the operator of the attachment from the ground. This could prove beneficial from a safety perspective. If the operator was isolated from the earth while operating the attachment, and the process of driving any type of installation encountered unforeseen below grade electrical potential, the operator would be safe from electrocution.

5. The operator station can be modified to swing into reach of the skid steer operator or automatically be positioned so operator of skid steer could also operate the ground rod driver as well as the Skid Steer.

6. The raising and lowering mechanism can be modified from hydraulic winch with cables to a hydraulic cylinder and ram that are directly connected to the sled, eliminating the need for cables and sheaves.

7. The design of the main beam can be modified be telescoping sections that would reduce the height when traveling and not in use. Similar to a forklift where each section provides additional height but when the sections are retracted they fit in each other in such a manner as to reduce the overall height of the attachment.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. A ground rod driver, comprising:

a support beam;

a hammer;

a sled attached to said hammer and that travels vertically along said support beam;

said hammer comprising:

an upper alignment plate;

a lower alignment plate;

a pair of vibration rods slidably engaged with said upper alignment plate and said lower alignment plate, and a vibration decoupler to isolate vibration of said hammer from said sled so that the vibration is not transferred to the rest of said ground rod driver; and means for controlling operation of said hammer;

means for controlling movement of said hammer, wherein said hammer operation is controlled separately from said hammer movement; and an attachment plate, sized and configured to enable said ground rod driver to be detachably connected to an industry standard skid steer.

2. The ground rod driver of claim 1, further comprising:

means for connecting said ground rod driver to a hydraulic power supply.

3. The ground rod driver of claim 1, wherein said hammer comprises a hydraulic hammer.

4. The ground rod driver of claim 1, each of said pair of vibration rods having an upper end and a lower end, said vibration decoupler further comprising at least one spring on each said upper end and each said lower end of each said vibration rods.

5. The ground rod driver of claim 1, said sled further comprising:

a body; and a plurality of wheels attached to either side of said body.

6. The ground rod driver of claim 5, said beam comprising a left side portion and a right side portion forming a hollow channel, wherein said sled travels within said hollow channel.

7. The ground rod driver of claim 5, said beam comprising an H-beam, wherein said sled travels on the outside of said H-beam.

8. The ground rod driver of claim 1, further comprising a footplate.

9. The ground rod driver of claim 8, said footplate further comprising an alignment notch.

10. The ground rod driver of claim 1, further comprising:

an upper drive cable;

a lower drive cable;

a drum having a separation plate dividing said drum into two portions, wherein said upper drive cable is wrapped around a first portion of said drum and said lower drive cable is wrapped around a second portion of said drum; and a motor operationally attached to said drum to cause rotation of said drum in a first direction and a second direction, wherein said upper drive cable is attached to a top portion of said sled and said lower drive cable is attached to a bottom portion of said sled, such that operation of said motor in the first direction causes said sled to move in an upward vertical direction and operation of said motor in the second direction causes said sled to move in a downward vertical direction.

11. The ground rod driver of claim 10, wherein said motor comprises a hydraulic motor.

12. An attachment for portable machinery, comprising:

a support beam;

an attachment plate sized and configured to enable said support beam to be detachably connected to an industry standard skid steer;

a hammer;

a sled attached to said hammer and that travels vertically along said support beam;

said hammer comprising:

an upper alignment plate;

a lower alignment plate;

a pair of vibration rods slidably engaged with said upper alignment plate and said lower alignment plate, and a vibration decoupler to isolate vibration of said hammer from said sled so that the vibration is not transferred to the rest of said attachment; and means for connecting said attachment to a hydraulic power supply;

means for controlling operation of said hammer; and means for controlling movement of said hammer, wherein said hammer operation is controlled separately from said hammer movement.

13. The attachment of claim 12, wherein said hammer comprises a hydraulic hammer.

14. The attachment of claim 12, each of said pair of vibration rods having an upper end and a lower end, said vibration decoupler further comprising at least one spring on each said upper end and each said lower end of each said vibration rods.

15. The attachment of claim 12, said sled further comprising:

a body; and a plurality of wheels attached to either side of said body.

16. The attachment of claim 12, further comprising:

an upper drive cable;

a lower drive cable;

a drum having a separation plate dividing said drum into two portions, wherein said upper drive cable is wrapped around a first portion of said drum and said lower drive cable is wrapped around a second portion of said drum; and a motor operationally attached to said drum to cause rotation of said drum in a first direction and a second direction, wherein said upper drive cable is attached to a top portion of said sled and said lower drive cable is attached to a bottom portion of said sled, such that operation of said motor in the first direction causes said sled to move in an upward vertical direction and operation of said motor in the second direction causes said sled to move in a downward vertical direction.

17. The attachment of claim 16, wherein said motor comprises a hydraulic motor.

* * * * *